US009573779B2

(12) United States Patent
Yamamoto

(10) Patent No.: US 9,573,779 B2
(45) Date of Patent: Feb. 21, 2017

(54) FEEDING APPARATUS AND PRINTING APPARATUS

(71) Applicant: CANON KABUSHIKI KAISHA, Tokyo (JP)

(72) Inventor: Kosuke Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 14/621,718

(22) Filed: Feb. 13, 2015

(65) Prior Publication Data

US 2015/0232292 A1 Aug. 20, 2015

(30) Foreign Application Priority Data

Feb. 19, 2014 (JP) ..... 2014-029480

(51) Int. Cl.
*B65H 3/52* (2006.01)
*B65H 3/06* (2006.01)
(Continued)

(52) U.S. Cl.
CPC ..... *B65H 3/5223* (2013.01); *B65H 3/0661* (2013.01); *B65H 3/0669* (2013.01); *B65H 3/0684* (2013.01); *B65H 3/52* (2013.01); *B65H 3/5207* (2013.01); *B65H 3/5215* (2013.01); *B65H 3/56* (2013.01); *B65H 7/00* (2013.01); *B65H 2402/46* (2013.01); *B65H 2403/512* (2013.01); *B65H 2403/5331* (2013.01); *B65H 2405/1134* (2013.01); *B65H 2511/20* (2013.01);
(Continued)

(58) Field of Classification Search
CPC ..... B65H 3/02; B65H 3/06; B65H 3/0661; B65H 3/46; B65H 3/52; B65H 3/5207; B65H 3/5215; B65H 3/5223; B65H 3/5246; B65H 3/5253; B65H 3/5261; B65H 2405/113; B65H 2405/1132; B65H 2405/1134; B65H 2405/1136; B65H 2515/81; B65H 2403/5331; B65H 1/02; B65H 2403/512; B65H 7/00; B65H 3/56; B65H 2405/20; B65H 2301/4232; B65H 2301/42328
See application file for complete search history.

(56) References Cited

U.S. PATENT DOCUMENTS 5,280,308 A 1/1994 Takahashi et al.
5,823,524 A * 10/1998 Kawada ..... B65H 3/5223 271/121
(Continued)

FOREIGN PATENT DOCUMENTS

JP 2001-253580 A 9/2001
JP 3501714 B2 3/2004

*Primary Examiner* — Prasad Gokhale
(74) *Attorney, Agent, or Firm* — Fitzpatrick, Cella, Harper & Scinto

(57) ABSTRACT

When waiting for printing, a cam that rotates together with the rotation of a gear locks a knurl at position on the upstream side in the sheet conveyance direction, which prevents sheets from dropping down. Moreover, during printing, when the cam is rotated 180° from the locked position, the knurl is in a state capable of sliding toward the downstream side. As a result, with the force that returns the knurl to the upstream side being too small, it is possible to prevent feeding overlapping sheet due to the front end of a sheet further on the down side than a sheet being fed from dropping toward the downstream side further than the knurl.

16 Claims, 10 Drawing Sheets

(51) Int. Cl.
*B65H 3/56* (2006.01)
*B65H 7/00* (2006.01)

(52) U.S. Cl.
CPC ..... *B65H 2511/416* (2013.01); *B65H 2515/81* (2013.01)

(56) References Cited

U.S. PATENT DOCUMENTS 6,382,621 B1 * 5/2002 Inoue ..... B65H 3/06 271/117
7,401,774 B2 * 7/2008 Ginzton ..... B65H 3/5223 271/121
8,079,589 B2 12/2011 Kinoshita et al.
8,152,167 B2 4/2012 Saito et al.
8,672,439 B2 3/2014 Suzuki et al.
2002/0008348 A1 * 1/2002 Inoue ..... B65H 3/0669 271/10.11
2003/0107634 A1 * 6/2003 Park ..... B65H 1/04 347/104
2003/0184003 A1 * 10/2003 Asada ..... B65H 3/0661 271/121
2004/0032077 A1 * 2/2004 Oh ..... B65H 3/5215 271/121
2004/0065992 A1 * 4/2004 Youn ..... B65H 3/56 271/121
2007/0222139 A1 * 9/2007 Hotani ..... B65H 3/5223 271/121
2010/0270731 A1 * 10/2010 Huang ..... B65H 3/0661 271/109
2013/0001859 A1 * 1/2013 Sugiyama ..... B65H 3/0684 271/10.09
2013/0020754 A1 * 1/2013 Schmidt ..... B65H 3/0684 271/19
2013/0043643 A1 * 2/2013 Hakamata ..... B65H 3/56 271/121
2014/0151954 A1 * 6/2014 Furusawa ..... B65H 3/5215 271/160

* cited by examiner

| FIG.9A | FIG.9B |
|---|---|

FEEDING APPARATUS AND PRINTING APPARATUS

BACKGROUND OF THE INVENTION

Field of the Invention

The present invention relates to a feeding apparatus and a printing apparatus, and more specifically to a feeding mechanism that separates and feeds sheets one by one using a separation surface.

Description of the Related Art

As a feeding mechanism that separates sheets using a separation surface, the feeding mechanism is known that uses two separation surfaces such as disclosed in Japanese Patent No. 3501714. The feeding mechanism that is disclosed in Japanese Patent No. 3501714 is such that the separation surface comprises a first separation surface, and a second separation surface that has a higher friction coefficient than the first separation surface, and is provided so as to be able to move along the first separation surface and in the direction of movement of a sheet that is output by a feed roller. By providing the second separation surface so as to be able to move, it becomes possible to feed sheets without deforming a sheet regardless of the stiffness of the sheet such as whether the sheet is thin or thick. Moreover, the second separation surface is able to prevent overlap feeding of sheets by an operation of returning to the upstream side by the elastic force of spring.

However, when applying the feeding mechanism disclosed in Japanese Patent No. 3501714 to a so-called auto-sheet feeder in which the sheet mounting surface of a sheet stacking device makes a comparatively large angle with respect to horizontal, and sheets are set so as to be inclined downward from the top, there are the following problems.

For example, when the elastic force of the spring that return the second separation surface to the upstream side is relatively weak, the second separation surface may move toward the downstream side due to the weight of plural sheets that are set on the sheet-mounting surface and due to the stiffness of the sheets. When the top sheet is separated and fed in such conditions, the front-end section of sheets other than the top sheet may become deformed along the separation surface due to the movement of the second separation surface, and the balance between the elastic force of the springs and the force acted by the sheets may be lost, resulting in only the second separation surface returning to the upstream side. As a result, the front ends of the sheets may drop further toward the downstream side than the second separation surface, the breaking force created by the high friction coefficient of the second separation surface may be lost and overlap feeding of sheets may occur. In contrast, when the elastic force of the spring is relatively large, for example, the second separation surface becomes unable to move and then may be unable to feed sheets or may damage the front ends of the sheets in the case of feeding sheets in a state of a small number of sheets stacked.

When various kinds of sheets having various thicknesses are set on the sheet-mounting surface, it is difficult to eliminate the problems related to sheet feeding through the second separation surface by adjusting the elastic force of the spring that return the second separation surface to the upstream side.

SUMMARY OF THE INVENTION

The object of the present invention is to provide a feeding apparatus and printing apparatus that make it possible for a feeding mechanism that uses a first separation surface and a movable second separation surface to perform sheet feeding well for various kinds of sheets.

In a first aspect of the present invention, there is provided a feeding apparatus that feeds a sheet that are stacked in a sheet stacking unit by feeding the sheet by means of a feeding unit and separating the sheet by means of a separation surface; the apparatus comprising: a movable separation surface that is provided so as to be able to move toward a downstream side and an upstream side in a direction in which the sheet is fed by the feeding unit; a pressing unit configured to press the movable separation surface toward the upstream side; and a prevention unit configured to, at a specified position within a range that the movable separation surface moves, prevent the movable separation surface from moving toward at least the downstream side.

With the construction described above, it becomes possible for a feeding mechanism that uses a first separation surface and a movable second separation surface to perform sheet feeding well for various kinds of sheets.

Further features of the present invention will become apparent from the following description of exemplary embodiments (with reference to the attached drawings).

DESCRIPTION OF THE EMBODIMENTS

Embodiments of the present invention will be explained below in detail with reference to the drawings.

First Embodiment

Figure 1:
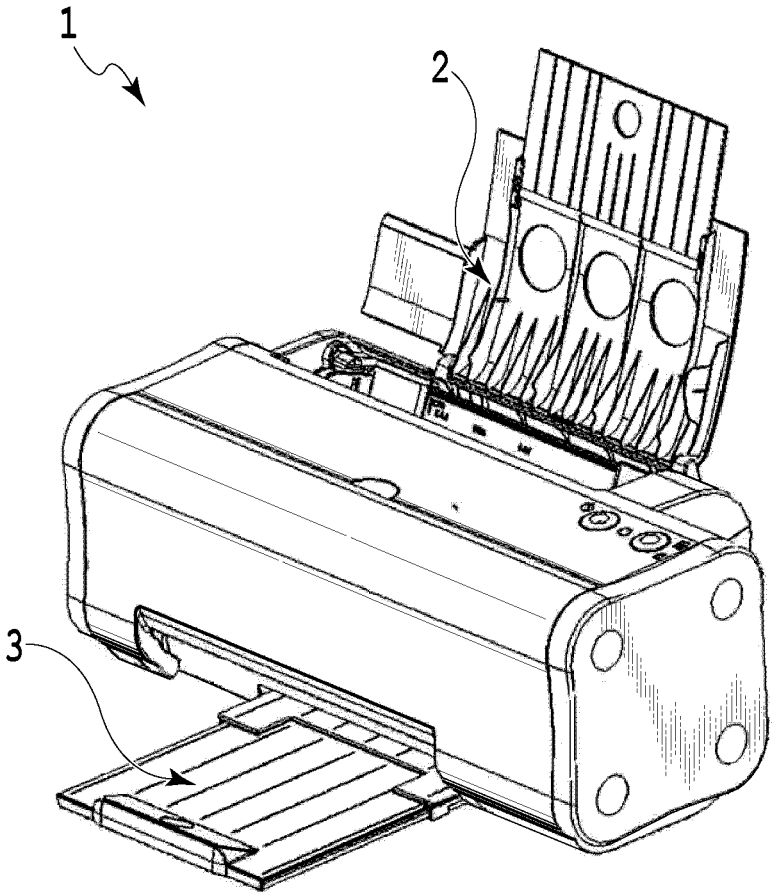
FIG. 1 is a perspective view illustrating a serial type inkjet printer according to a first embodiment of the present invention.
Figure 2:
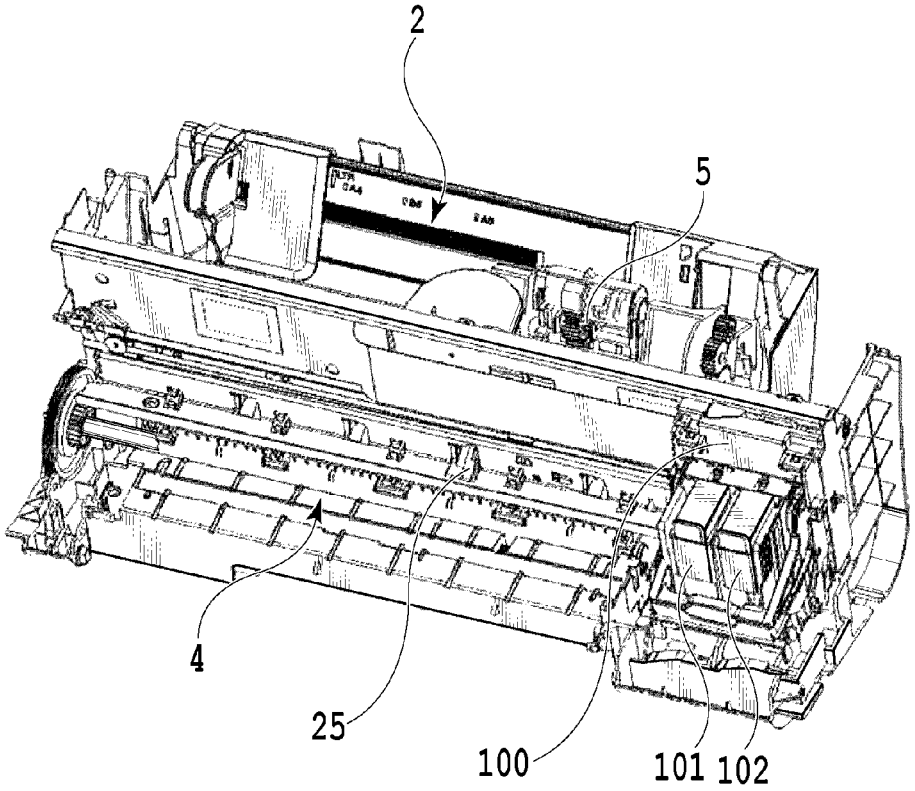
FIG. 2 is a perspective view illustrating the printing section of the printer, with the exterior in FIG. 1 removed.

FIG. 1 is a perspective view illustrating a serial type inkjet printer according to a first embodiment of the present invention; FIG. 2 is a perspective view illustrating the printing section of the printer, with the exterior in FIG. 1 removed; and FIG. 3 is a perspective view particularly illustrating the feeding and separating sections, with the printing section in FIG. 2 removed.

In FIG. 1, an inkjet printer 1 as the printing apparatus, comprises an auto-sheet feeder (hereafter, referred to as an ASF) 2 as the feeding apparatus and a sheet discharge tray 3. In this embodiment, the ASF 2 is constructed so as to be able to be installed in or removed from the printer 1. The ASF 2 is such that a maximum of 100 sheets can be mounted, and this ASF 2 separates the sheets one by one and feeds the sheets to a printing section of the printer 1. A sheet that has been subjected to printing by the printer 1 are discharged and stacked on the discharge tray 3. In FIG. 2, in a printing section 4, a carriage 100 is moved for scanning a sheet by print heads 101, 102 that are integrated with ink tanks and mounted in the carriage 100. While scanning, printing is performed on the sheet by ejecting ink from the print heads 101, 102 according to print data.

Figure 3:
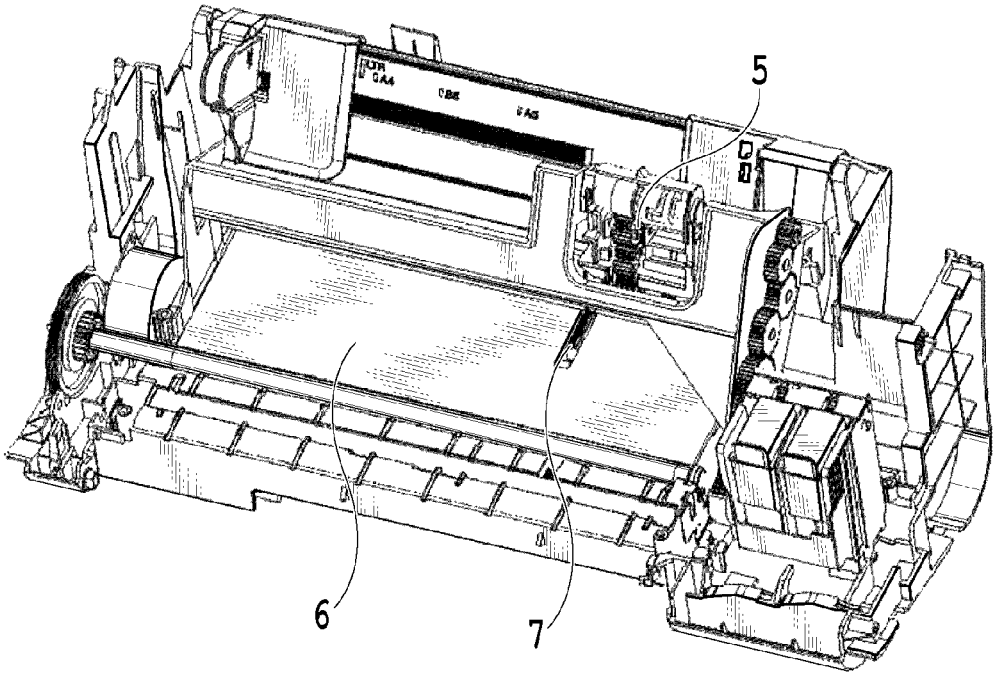
FIG. 3 is a perspective view particularly illustrating the feeding and separating sections, with the printing section in FIG. 2 removed.

In FIG. 2 and FIG. 3, the ASF 2 is provided with a swing-arm unit 5, and a feed roller 8 is attached to the front end of the swing-arm unit 5. The feed roller 8 is rotated by a drive mechanism that will be described later, to pick up and feed the top sheet of the sheets that are stacked on the sheet-mounting surface of the ASF 2. A first separation surface (other separation surface) 6 that is provided in the ASF 2, together with a knurl 7 that functions as a second separation surface (movable separation surface) applies a separation resistance to a sheet that is picked up and fed by the roller 8. A medium passing sensor lever (hereafter, referred to as a PE sensor lever) 25 is provided near the output of the ASF 2, and a transmission type optical sensor (not illustrated in the figure) detects when the lever rotates due to the front end of a sheet passing by, and as a result, it is possible to detect the passing of the end of the sheet. By detecting the passing of the front end of the sheet, it is possible to determine the position of the sheet that was fed and conveyed.

Figure 4:
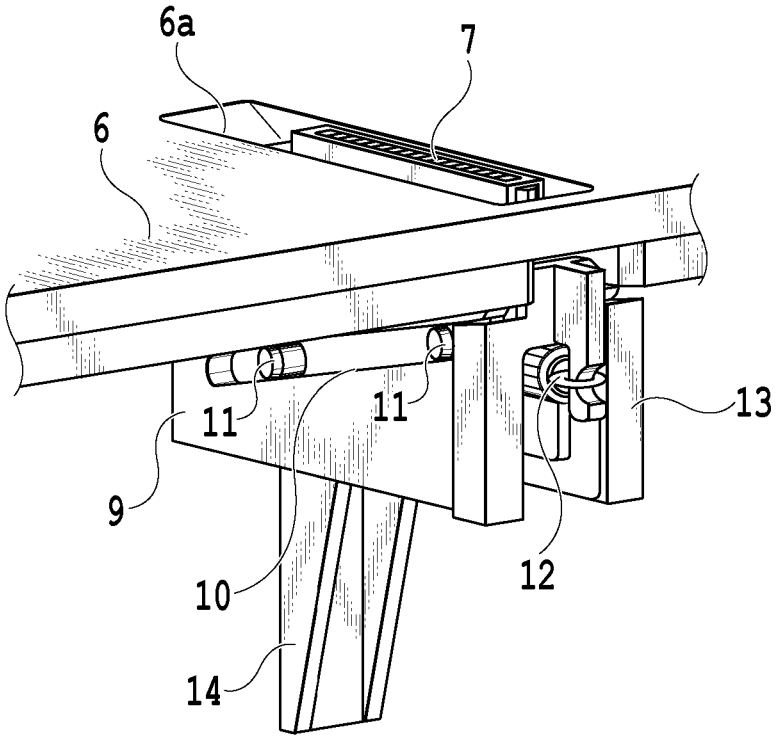
FIG. 4 is a perspective view of a section around a knurl of a first embodiment of the present invention as seen from a diagonal upstream direction.
Figure 5:
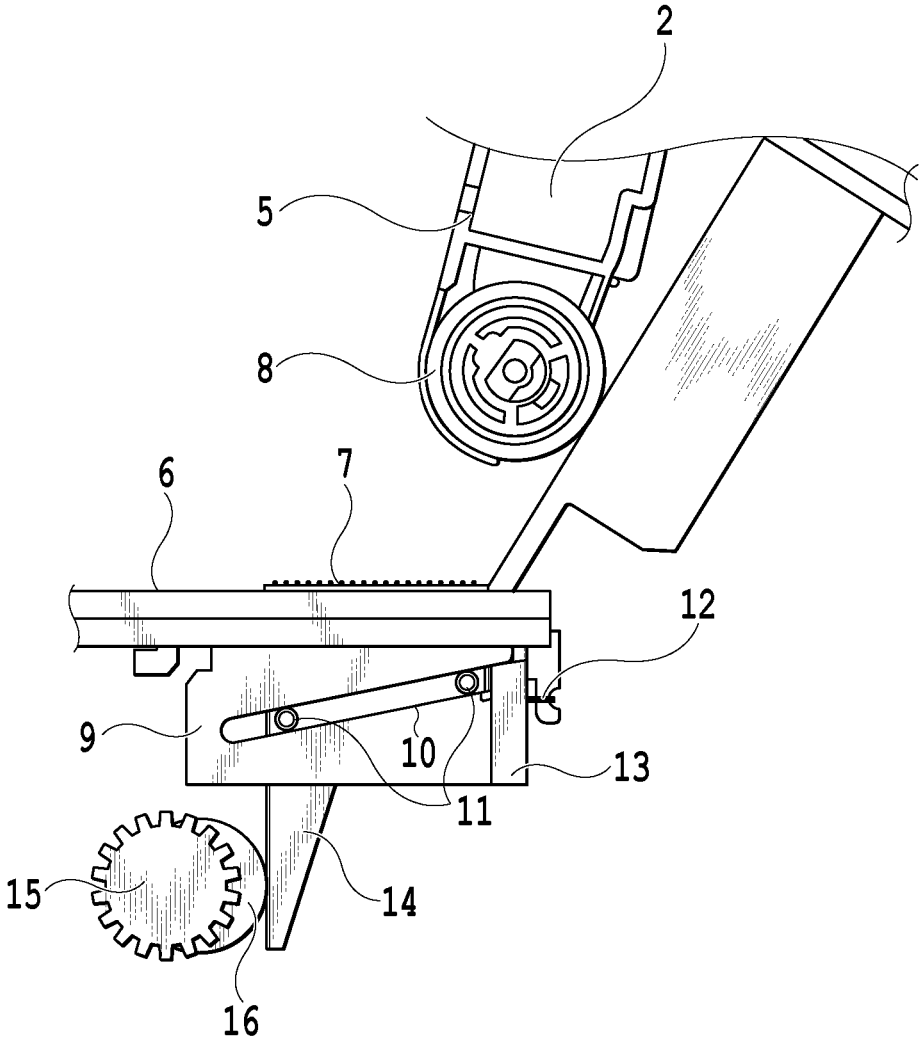
FIG. 5 is a side view of a section around the knurl as seen from the side.

FIG. 4 and FIG. 5 illustrate the construction near the knurl 7, which is the second separation surface; where FIG. 4 is a perspective view of a section around the knurl as seen from a diagonal upstream direction, and FIG. 5 is a side view of a section around the knurl as seen from the side.

As illustrated in FIG. 5, the top surface of the knurl 7 has a concave-convex shape that generates a resistant force when the front end of a sheet that is picked up and fed by the roller 8 enters a valley of the concave-convex surface. The knurl 7 of this embodiment is formed using resin. Other examples of a material for the knurl may include: rubber that applies a resistive force by utilizing the high coefficient of friction between the rubber and sheet; increasing the resistive force of the rubber by forming an uneven surface; using a high friction member such as cork; metal on which a concave-convex shape is formed, and the like. These materials that are provided with the objective of applying a resistive force to a sheet when in contact with the sheet, and give a friction force that is high compared with that of the first separation surface (other separation surface) 6 are included in the second separation surface.

The knurl 7 is provided so as to be placed in an opening 6*a* that is provided on the separation surface, and a lower knurl portion that extends below the opening 6*a* is provided on the knurl 7. The lower knurl portion is formed so as to be integrated with a cam follower 14 that will be described later. Moreover, four pins 11 are provided on the lower knurl portion so as to protrude out from the lower knurl portion. Two guiding sections 9 that are each provided with a guide surface 10 are attached to the rear surface side of the separation surface 6 so as to be on both sides of the lower knurl portion. The four pins 11 of the knurl 7 are set in the guide surface 10 so that the knurl 7 is able to slide along the guide surfaces 10. The guiding surfaces 10 incline downward toward the downstream side in sheet feeding, and therefore the knurl 7 moves so as to retract downward from the separation surface 6 while sliding toward the downstream side. Moreover, the knurl 7 is pressed toward the upstream side by a knurl spring 12. As a result, the initial position of the knurl 7 is at a position that protrudes out further than the first separation surface 6. An upstream side end hook of the spring 12 is provided on a cap 13, and the cap 13 is mounted on the guiding section 9. The elastic force of the knurl spring 12 is set to 100 gf for example so that when the knurl 7 is located on the upstream side, the knurl 7 will not slide to the downstream side under the weight of the sheets when the maximum amount of sheets are mounted in the sheet stacking section. A cam 16 of a cam gear 15 comes in contact with a cam follower 14 of the knurl 7. The cam gear 15 is supported by a bottom case 103 (FIG. 2) so as to be able to rotate around the center axis of the gear.

Figure 6:
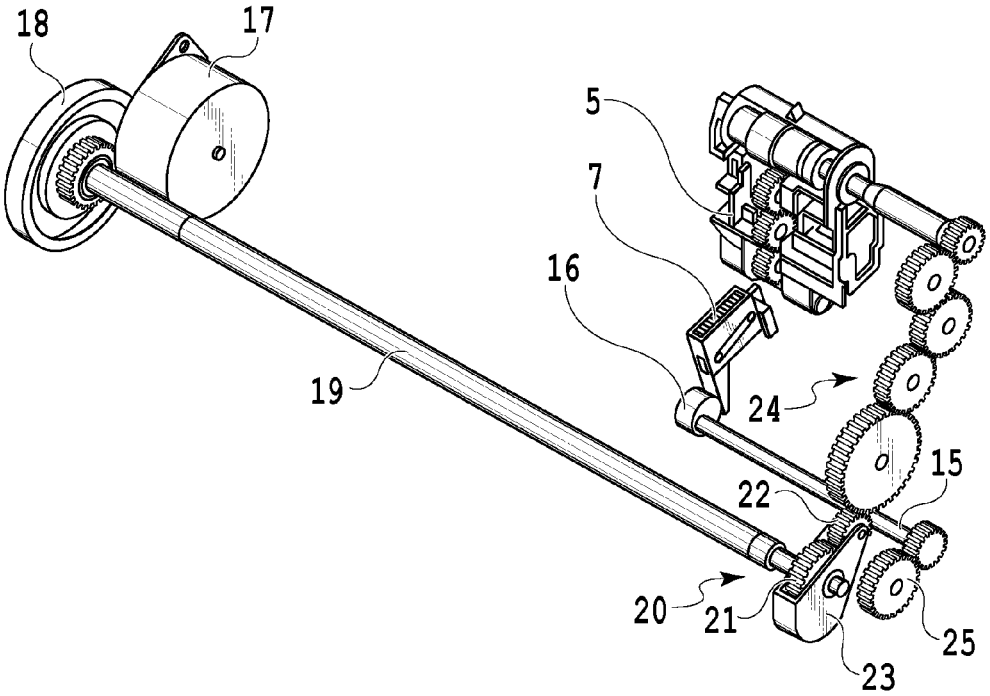
FIG. 6 is a perspective view illustrating the driving force transmission system of a printer according to the first embodiment of the present invention.

FIG. 6 is a perspective view illustrating the drive force transmission system of the printer according to this embodiment, and particularly omits the support members of all of the components that support the drive force transmission system with respect to the ASF 2 for illustrating only the transmission path. In FIG. 6, the drive force generated by a LF motor 17 is transmitted by way of a motor gear (not illustrated in the figure) to the drive system of the ASF 2 through a LF roller gear 18, a LF roller 19, and a LF output pendulum gear unit 20. An encoder wheel (not illustrated in the figure) is provided on the same axis as the LF motor 17 and, by way of an encoder sensor (also not illustrated in the figure), detects the rotation angle and speed of the motor, and as a result, it is possible to control the drive of the LF motor 17. The pendulum gear unit 20 comprises a sun gear 21, a planet gear 22 and pendulum holder 23. When the LF motor 17 is rotated in a direction such that the LF roller 19 rotates in the forward direction (conveying direction), the pendulum gear unit 20 swings to the side of an idling gear train 24, and drive force is transmitted to a swing arm unit 3. On the other hand, when the LF roller 19 rotates in the reverse direction, the pendulum gear unit 20 swings to the side of the cam gear 15, and rotates the cam gear 15 by way of an idling gear 25.

The cam 16 of the cam gear 15 comes in contact with the cam follower 14 that is integrated with the knurl 7 to prevent the cam follower 14 from moving to the downstream side. When the cam 16 is at the position shown in FIG. 5, it is at the furthest position on the upstream side of the knurl 7 that is integrated with the cam follower 14, and the knurl 7 is in a locked state at this position. A sensor flag (not illustrated in the figure) is integrally provided with the cam gear 15, and the rotating phase of that flag can be identified by a transmission type optical sensor (not illustrated in the figure). Moreover, the cam 16 of the cam gear 15 is eccentric with respect to the gear shaft. As a result, in the range of rotating the gear 15 180° from the position illustrated in FIG. 5, the restricted position of the cam follower 14 moves toward the downstream side. In other words, the knurl 7 is able to slide toward the downstream side.

In this embodiment, when the printer is in a standby state, the knurl 7 is in the locked state as illustrated in FIG. 5 to prevent sheets from dropping down. Moreover, during printing, the gear 15 (cam 16) is rotated to a position 180° from the position shown in FIG. 5 so that the knurl 7 is in a state capable of sliding toward the downstream side. As a result, the front end of the lower sheets than the sheet to be fed can be prevented from dropping down toward the downstream side further than the knurl 7, which is caused the force being too small for the knurl 7 to return to the upstream side, and thus the overlap feeding of sheets can be prevented. Furthermore, the force returning the knurl 7 to the upstream side being too large which causes the knurl 7 to be unable to move, for example, when feeding sheets in a state that there is only a small number of stacked sheets, can be prevented from causing sheets not to be fed, or causing the front end of the sheets to be damaged. By using mechanism in which the knurl 7 is secured (locked) in this way, it is not necessary to increase the range of the elastic force for returning the knurl 7 to the upstream side depending on the type of sheet, and it is possible to set the elastic force within a specified limited range. As a result, it is possible to feed sheets well according to various kinds of sheets.

When rotating the cam gear 15 again and restricting the position of the knurl 7 further on the upstream side, it is possible to forcibly return the knurl 7 to the initial waiting position by the cam 16 even when it is difficult for the spring to return the knurl 7 due to the position of the plural stacked sheets. Therefore, when the printer is in the standby state, the sheets always return to a position along the feeding tray without dropping down toward the downstream side. Moreover, it is possible, for example, for the pressure applied when the user sets the sheets or for the weight of the sheets itself to prevent the movable knurl from moving toward the downstream side and prevent sheets from being inserted too far toward the back. As a result, it is possible to easily know how far to insert the sheets when setting the sheets, and thus it is possible to improve operability.

Figure 8:
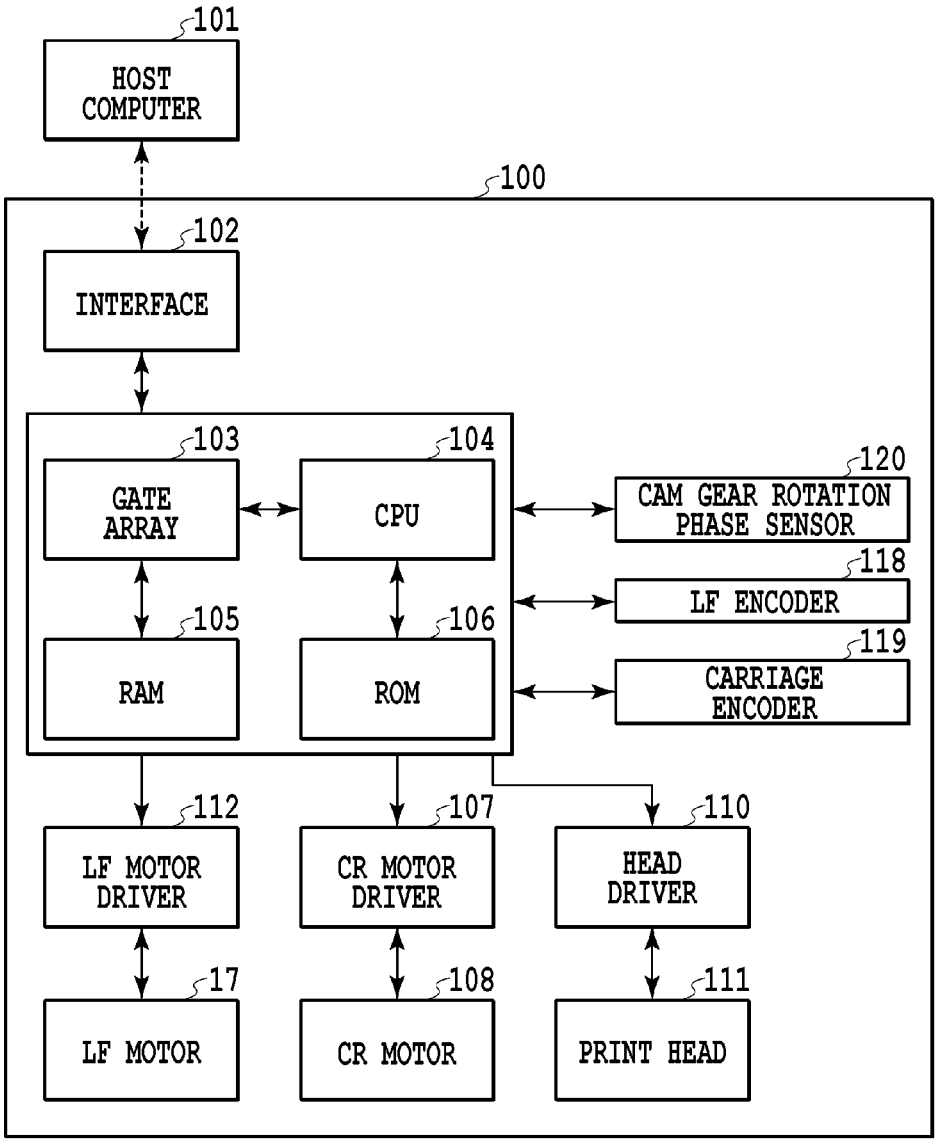
FIG. 8 is a block diagram illustrating the control configuration of an inkjet printing apparatus of an embodiment of the present invention.

FIG. 8 is a block diagram illustrating the control configuration for performing printing control of an inkjet printing apparatus according to this embodiment.

In FIG. 8, a reference sign 100 denotes an inkjet printing apparatus. A reference sign 102 denotes an interface that is provided in the printing apparatus and that connects the inkjet printing apparatus 100 and host computer 101, receives printing data and specified values about the medium and the like from the host computer 101, and returns various kinds of status to the host computer 101. A reference sign 103 denote a gate array, a reference sign 104 denotes a CPU, a reference sign 105 denotes RAM and a reference sign 106 denotes ROM. When printing data is sent from the host computer 101, that printing data is temporarily stored in RAM 105 via the gate array 103. After that, the printing data is converted by the gate array 103 from raster data to a printing image, and is then stored again in RAM 105. The printing image is transmitted to the print head 111 by way of the gate array 103 and head driver 110, and then printing is performed by ejecting ink from the head.

ROM 106 is a read only memory device that stores various programs such as control programs for the printing apparatus, and the CPU 104 references these control programs in order to execute processing and control that will be described later using FIG. 7 and FIGS. 9A and 9B.

Reference signs 107 and 112 denote motor drivers that are control circuits for controlling the carriage motor 108 and feed motor (LF motor) 17 for performing the printing operation of the serial type inkjet printing apparatus of this embodiment. A reference sign 118 denotes a LF encoder and a reference sign 119 denotes a carriage encoder; where the operating distance and operating speed are detected from respective encoder signals, and the motors are controlled according to feedback to the motors that corresponds to detected signals. A reference sign 120 denotes a cam gear angle phase sensor that detects the angle phase of the cam gear 15.

Figure 7:
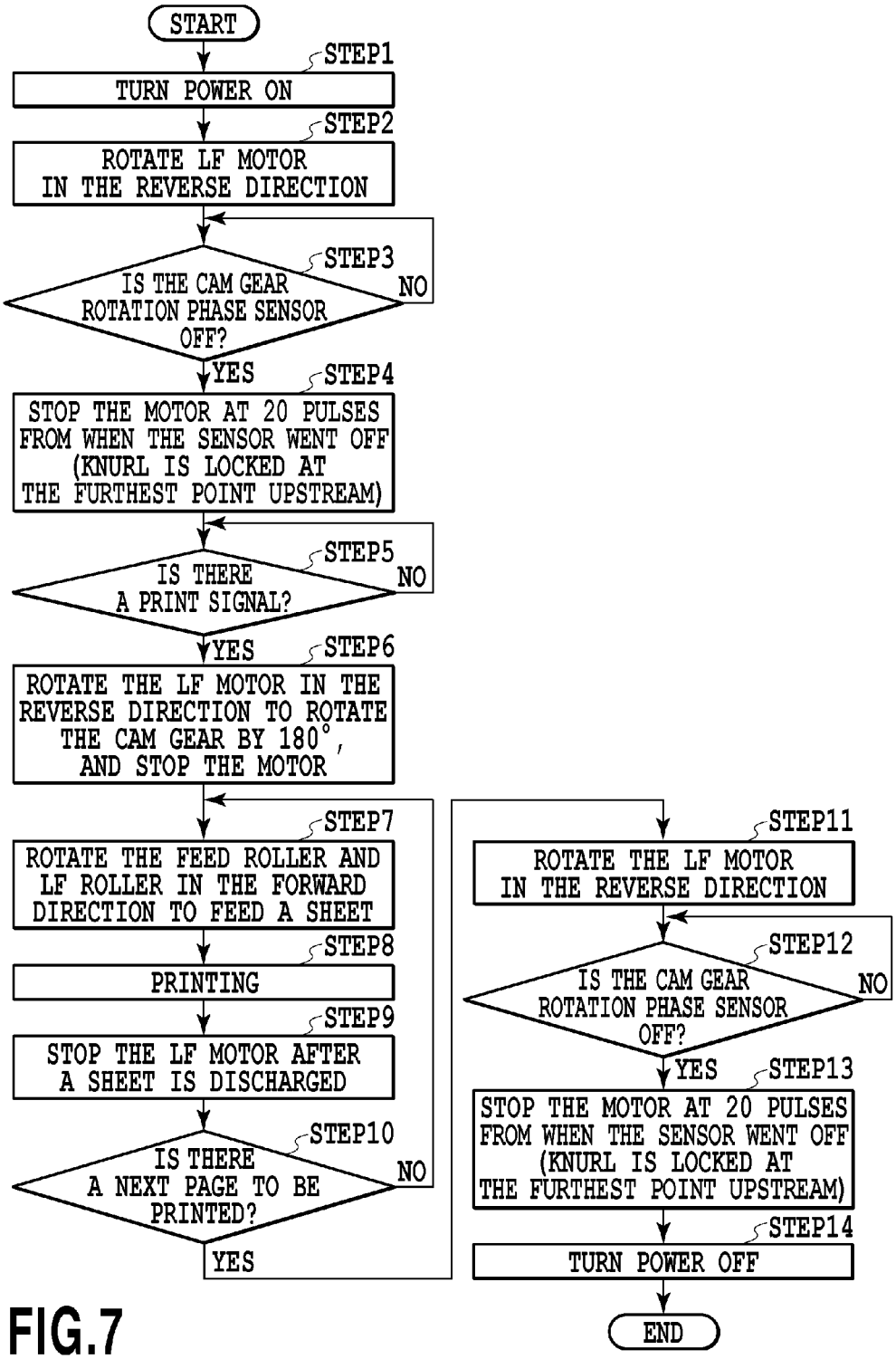
FIG. 7 is a flowchart illustrating the sheet feeding operation of a first embodiment of the present invention.

FIG. 7 is a flowchart that illustrates the feed operation of this embodiment. The processing illustrated in FIG. 7 is executed by the CPU 104 described above in FIG. 8 controlling the rotation of the LF motor 17 according to a feed operation control program, and based on signals from the LF encoder 118 and cam gear rotation phase sensor 120 described above. In FIG. 7, the power is turned ON in STEP 1, and the LF motor 17 is drive to rotate in reverse in STEP 2. As a result, the driving force is transmitted to the cam gear side, and in STEP 3, it is determined whether or not the rotation phase sensor is blocked (OFF). When the sensor is OFF, then in STEP 4, the motor 17 stops at the phase when the LF encoder 118 has rotated 20 pulses from when the sensor went OFF. At this phase, the knurl 7 is locked at the furthest point on the upstream side in the conveyance direction. In STEP 5, it is checked whether or not there is a printing signal, and when there is no signal, the motor waits as is, and when there is a signal, then in STEP 6, the LF motor 17 is driven to rotate the cam 16 180° and stops. At this phase, the knurl 7 is released from being locked and is able to slide. Then, in STEP 7, the LF motor 17 rotates in the forward direction, and rotates the LF roller and feed roller in the conveyance direction. By the operation of the knurl 7 and separation surface 6, only one sheet is picked up, and that sheet is conveyed to the printing section in STEP 8 and is subjected to printing by the LF roller intermittently forwarding the sheet and by repeating scanning by the print head.

In STEP 9, the LF motor 17 is continuously driven, and after the sheet has been discharged, the LF motor 17 stops. In STEP 10, it is determined whether or not there is a next page to be printed, and when there is a next page, processing returns to STEP 7, and a sheet is fed. When there is no next page, then in STEP 11, the LF motor 17 is rotated in the reverse direction, and in STEP 12, it is determined whether or not the rotation phase sensor is blocked (OFF), and when the sensor is OFF, then in STEP 13 the LF motor 17 is stopped at the phase after the LF encoder 118 has rotated 20 pulses. Then, in STEP 14 the power is turned OFF and the operation ends.

In the embodiment described above, the knurl was in a locked state at the furthest point on the upstream side, however, the embodiment is not limited to this, and as long as the knurl is in a state of protruding out from the surrounding separation surface 6, at least movement toward the downstream side can be prevented at any position within the movable range.

Second Embodiment

A second embodiment of the present invention is related to another embodiment of the function of the knurl 7 when feeding a sheet. More specifically, depending on the medium type setting that is set by the user, for sheets that have a low stiffness such as normal paper and that have a small load when being fed, the knurl 7 is in a locked state during feeding of the sheets, and in the case of a medium having high stiffness such as photographic paper, the locked state is released when feeding sheets. As a result, for normal paper which has low resistance when being separated and easily causes the overlap feeding of sheets, it is possible to more surely prevent the overlap feeding of sheets. Moreover, construction is such that when according to the output of a sensor that detects whether or not there are any sheets, it is determined that during printing there are no more sheets, the knurl automatically returns to the locked state in order to supply more sheets, so together with being able to improve the setting characteristics when setting sheets, it is possible to prevent the feeding of overlapping sheets due to sheets slipping and dropping down when setting the sheets.

Figures 9, 9A:
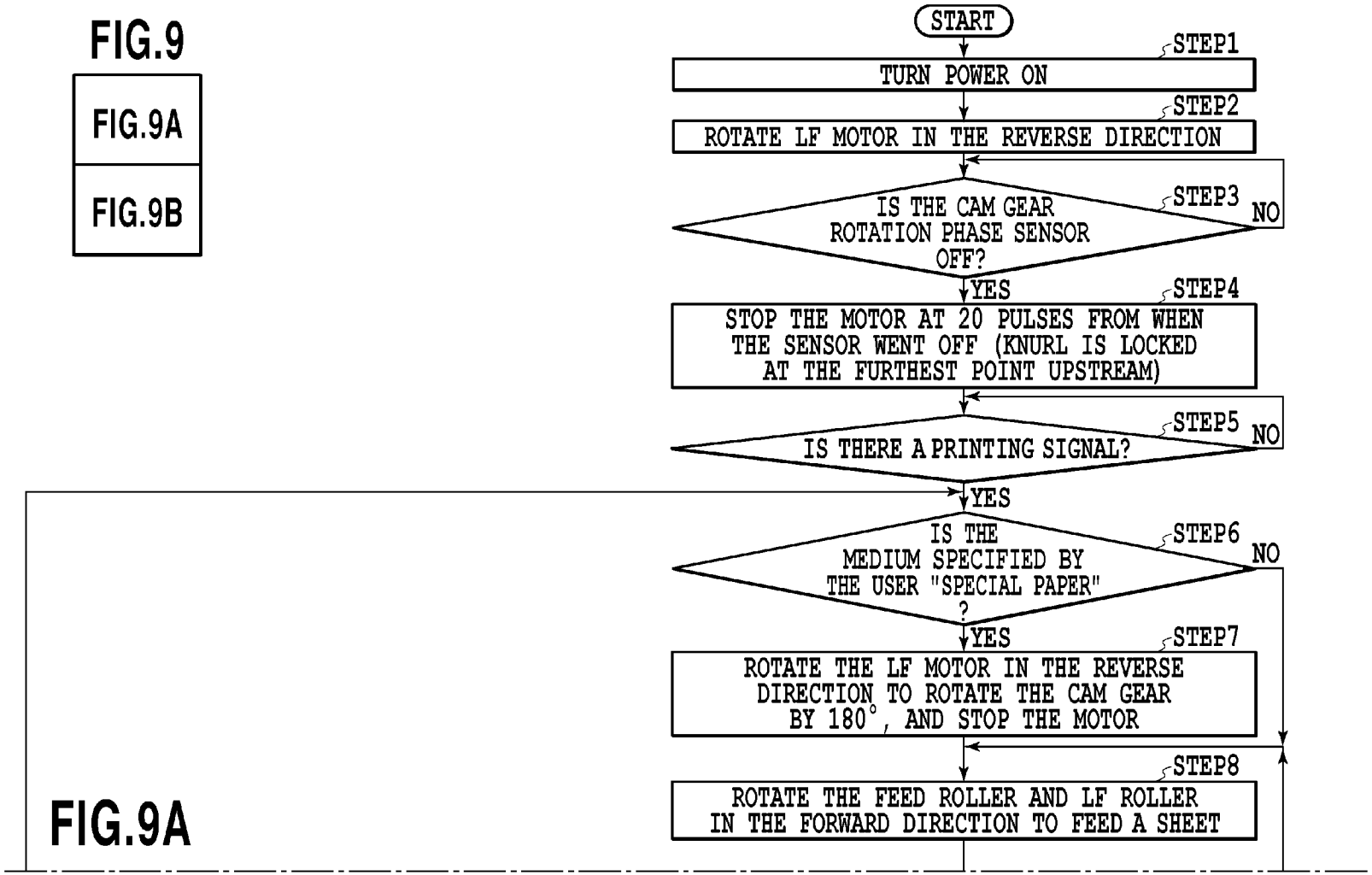
FIG. 9 is a diagram showing a relationship between FIG. 9A and FIG. 9B, and FIGS. 9A and 9B are flowcharts illustrating the sheet feeding operation according to a second embodiment of the present invention.
Figure 9B:
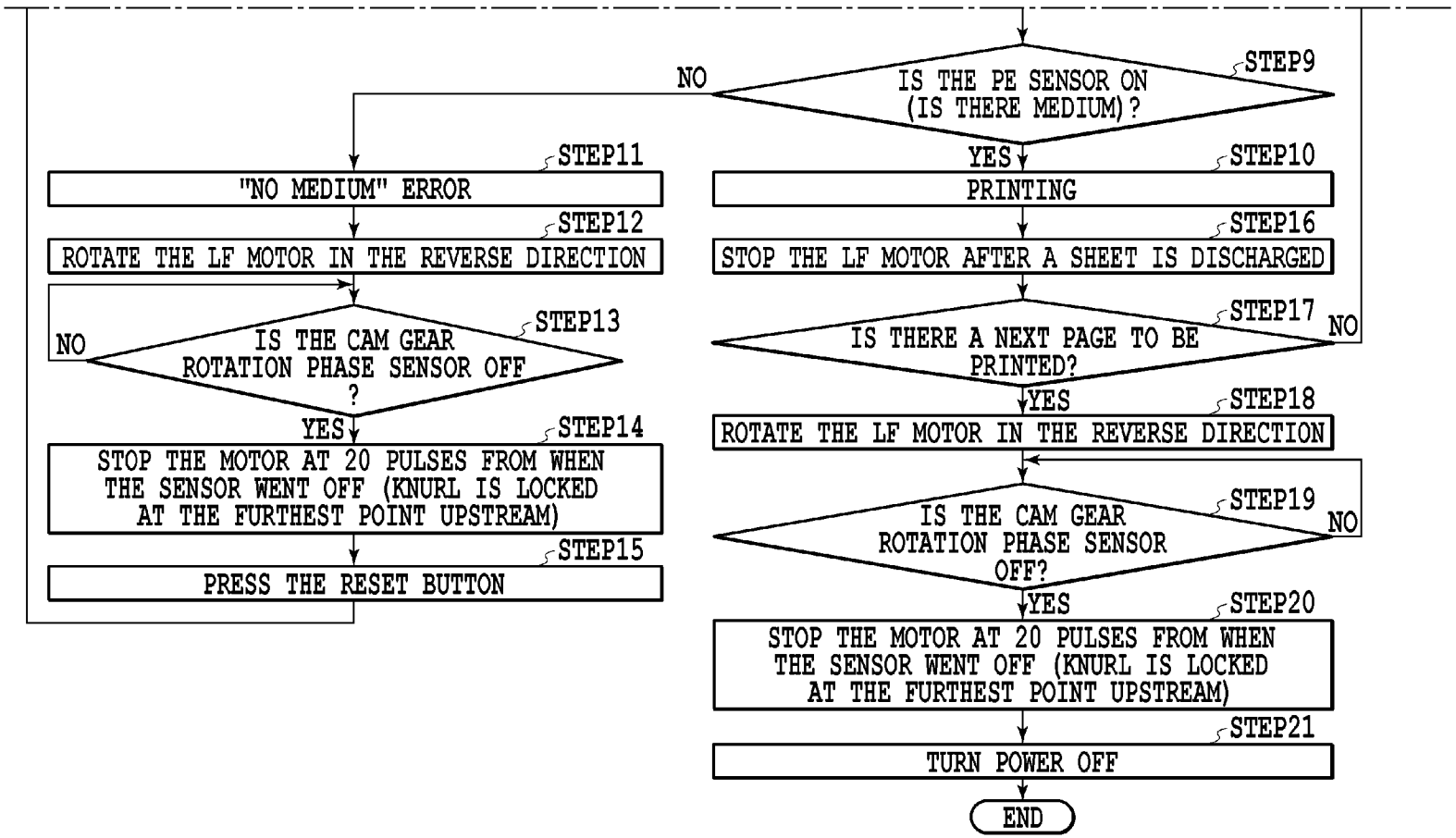

FIGS. 9A and 9B are flowcharts illustrating the feeding operation according to the second embodiment of the present invention. The construction of the apparatus of this embodiment is the same as that in the first embodiment described above, so an explanation thereof is omitted. The processing illustrated in FIGS. 9A and 9B is executed by the CPU 104 described above in FIG. 8 controlling the rotation of the LF motor 17 according to a control program for the feeding operation, and based on signals described above from the LF encoder 118, the cam gear rotation phase sensor 120, and PE sensor which detects the end of another sheet.

In FIGS. 9A and 9B, after the power to the apparatus is turned ON in STEP 1, in STEP 2, the LF motor 17 is driven to rotate in the reverse direction. As a result, the driving force is transmitted to the cam gear side, and in STEP 3 it is determined whether or not the rotation phase sensor 120 is blocked (OFF), and when it is determined that the sensor is OFF, then in STEP 4 the motor stops at the rotation phase where the LF encoder 118 counts 20 pulses from when the sensor went OFF. At this phase, the knurl 7 is locked at the point furthest on the upstream side in the conveyance direction. In STEP 5, it is checked whether or not there is a printing signal, and when there is no signal, the motor waits as is, and when there is a signal, then in STEP 6, it is determined whether type of sheet that was specified by the printer driver of the host computer is special paper for printing photos, or normal paper.

In the case of special paper, then in STEP 7, the LF motor 17 is driven and the cam 16 is rotated 180°. At this phase, the knurl 7 is released from the locked state and is able to move. When it was determined that the sheets are normal paper, processing skips STEP 7 and moves to STEP 8. In the case of normal paper, the feeding operation is performed with the knurl 7 in the locked state as is.

In STEP 8, the LF motor 17 is rotated in the forward direction, which rotates the LF roller and feed roller in the conveyance direction. When there is a sheet, only one sheet is picked up by the operation of the knurl 7 and the separation surface 9, and in STEP 9, the passing of the front end of that sheet is detected by the PE sensor lever unit. When there is no sheet, passage of a sheet is not detected, so it is determined that there is no medium, so in STEP 11, a "No Medium" error occurs, and the error is displayed on the screen of the host computer. In STEP 12, the LF motor 17 is rotated in the reverse direction. As a result, the driving force is transmitted to the cam gear side, and in STEP 13 it is determined whether or not the rotation phase sensor is blocked (OFF), and when it is OFF, in STEP 14 the LF motor 17 stops at the phase after the LF encoder 118 has rotated 20 pulse detections for when the sensor went OFF. At this phase, the knurl 7 is locked at the furthest point on upstream side in the conveyance direction. In STEP 15, after sheets have been supplied, and the reset button has been pressed on the host computer screen, processing returns to STEP 6, and the same routine is repeated.

In STEP 9, when it is determined that the PE sensor is ON, then in STEP 10 a sheet is conveyed to the printing section, and printing is performed by intermittently forwarding the sheet and repeating scanning by the print head. Then, in STEP 16, the LF motor 17 is continuously driven, and after the sheet is discharged, stops. In STEP 17, it is determined whether or not there is a next page to be printed, and when there is a next page, processing returns to STEP 8 and a sheet is fed. When there is no next page, then in STEP 18 the LF motor 17 is rotated in the reverse direction, and in STEP 19 it is determined whether or not the rotation phase sensor is blocked (OFF), and when the sensor is OFF, in STEP 20 the LF motor 17 stops at the phase after the LF encoder 118 has rotated 20 pulses from when the sensor went OFF. Then in STEP 21, the power is turned OFF and the operation ends.

Other Embodiments

Each of the embodiments above comprises a fixed first separation surface (other separation surface) and a movable second separation surface (movable separation surface), and relates to a form of separating sheets that are fed, however, application of the present invention is not limited to this form. For example, it is also possible for the second separation surface (movable separation surface) to comprise plural knurls 7 and mechanisms for moving or securing the knurls 7 in the direction which cross with the direction that sheets are fed without comprising a first separation surface (other separation surface), and to perform separation by using these plural knurls 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-029480, filed Feb. 19, 2014, which is hereby incorporated by reference wherein in its entirety.

What is claimed is:

1. A feeding apparatus comprising:

a sheet stacking unit provided with an inclined plane for stacking a plurality of sheets;

a movable separation surface which is provided so as to lie at an angle with the inclined plane and so as to support lower side ends of the stacked sheets in a gravitational force direction, which provides a resistance force to separate the fed sheet from the sheet stacking unit, the fed sheet provided so as to be able to move along a surface of said movable separation surface toward a downstream side and an upstream side of a path for the fed sheet, and the movable separation surface adapted to move toward the downstream side by a force in the sheet feeding direction due to a weight of the stacked sheets;

an other separation surface which is provided so as to lie at an angle with the inclined plane, and that is different from said movable separation surface, and that applies a resistance force to the fed sheet that is smaller than resistance force applied by said movable separation surface, wherein the movable separation surface and the other separation surface are arranged in a direction crossing the path; and a prevention unit configured to, in a case where the movable separation surface is located at a specified position within a range that the movable separation surface moves, prevent the movable separation surface from moving toward at least the downstream side, wherein at the specified position, said movable separation surface protrudes out from said other separation surface in a moving direction of said movable separation surface, and further comprising a control unit configured to control the prevention unit so that said prevention unit prevents said movable separation surface from moving when a printing section for performing printing is in a standby state.

2. The feeding apparatus according to claim 1, further comprising a control unit configured to perform control so that said prevention unit prevents said movable separation surface from moving when a printing section for performing printing is in a standby state.

3. The feeding apparatus according to claim 2, wherein said control unit determines, depending on the type of sheets being fed, whether or not to prevent movement of said movable separation surface.

4. The feeding apparatus according to claim 1, wherein the range in which said movable separation surface moves is from a position where said movable separation surface protrudes out to from said other separation surface up to a position that is retracted further from said other separation surface.

5. The feeding apparatus according to claim 1, wherein said prevention unit secures said movable separation surface at the furthest position on the upstream side of a range in which said movable separation surface moves.

6. The feeding apparatus according to claim 1, further comprising a unit configured to detect whether or not there is a sheet to be fed, wherein when said unit detects that there is no sheet to be fed, said prevention unit secures said movable separation surface.

7. The feeding apparatus according to claim 1, wherein the prevention unit prevents the movable separation surface from moving toward at least the downstream side at a specified position regardless of the weight of the stacked sheets.

8. The feeding apparatus according to claim 1, wherein the control unit causes the movable separation surface, which is supporting the sheets, to move toward the upstream side in a case where printing is completed.

9. A printing apparatus that performs printing on a sheet separated and fed from a sheet stacking unit, said apparatus further comprising:

a sheet stacking unit provided with an inclined plane for stacking a plurality of sheets;

a movable separation surface which is provided so as to lie at an angle with the inclined plane and so as to support lower side ends of the stacked sheets in a gravitational force direction, which provides a resistance force to separate the fed sheet from the sheet stacking unit, the fed sheet provided so as to be able to move along a surface of said movable separation surface toward a downstream side and an upstream side of a path for the fed sheet, and the movable separation surface adapted to move toward the downstream side by a force in the sheet feeding direction due to a weight of the stacked sheets;

an other separation surface which is provided so as to lie at an angle with the inclined plane, and that is different from said movable separation surface, and that applies a resistance force to the fed sheet that is smaller than resistance force applied by said movable separation surface, wherein the movable separation surface and the other separation surface are arranged in a direction crossing the path;

a prevention unit configured to, in a case where the movable separation surface is located at a specified position within a range that the movable separation surface moves, prevent the movable separation surface from moving toward at least the downstream side; and a printing unit configured to perform printing to the sheet, wherein at the specified position, said movable separation surface protrudes out from said other separation surface in a moving direction of said movable separation surface, and further comprising a control unit configured to control the prevention unit so that said prevention unit prevents said movable separation surface from moving when a printing section for performing printing is in a standby state.

10. The printing apparatus according to claim 9, further comprising a control unit configured to perform control so that said prevention unit prevents said movable separation surface from moving when a printing section for performing printing is in a standby state.

11. The printing apparatus according to claim 10, wherein said control unit determines, depending on the type of sheets being fed, whether or not to prevent movement of said movable separation surface.

12. The printing apparatus according to claim 9, wherein the range in which said movable separation surface moves is from a position where said movable separation surface protrudes out to from said other separation surface up to a position that is retracted further from said other separation surface.

13. The printing apparatus according to claim 9, wherein said prevention unit secures said movable separation surface at the furthest position on the upstream side of a range in which said movable separation surface moves.

14. The printing apparatus according to claim 9, further comprising a unit configured to detect whether or not there is a sheet to be fed, wherein when said unit detects that there is no sheet to be fed, said prevention unit secures said movable separation surface.

15. The printing apparatus according to claim 9, wherein the prevention unit prevents the movable separation surface from moving toward at least the downstream side at a specified position regardless of the weight of the stacked sheets.

16. The printing apparatus according to claim 9, wherein the control unit causes the movable separation surface, which are supporting the sheets, to move toward the upstream side in a case where printing is completed.

* * * * *